United States Patent [19]

Harasym

[11] Patent Number: 4,746,037

[45] Date of Patent: May 24, 1988

[54] APPARATUS FOR UNPLUGGING A VESSEL DISCHARGE PORT

[75] Inventor: Michael F. Harasym, Havertown, Pa.

[73] Assignee: Vesuvius Crucible Company, Pittsburgh, Pa.

[21] Appl. No.: 930,484

[22] Filed: Nov. 14, 1986

[51] Int. Cl.[4] ..... C21C 5/48

[52] U.S. Cl. ..... 222/591; 222/603; 266/271

[58] Field of Search ..... 222/593, 603, 591, 523; 266/236, 271; 239/124

[56] References Cited

U.S. PATENT DOCUMENTS

| | | | |
|---|---|---|---|
| 247,855 | 10/1881 | Smalley | 222/523 |
| 3,770,200 | 11/1973 | Bauer et al. | 239/124 X |
| 4,450,986 | 5/1984 | Harasym et al. | 222/591 |

FOREIGN PATENT DOCUMENTS

| | | | |
|---|---|---|---|
| 2403522 | 4/1975 | Fed. Rep. of Germany | 266/271 |

*Primary Examiner*—Joseph J. Rolla
*Assistant Examiner*—Nils E. Pedersen
*Attorney, Agent, or Firm*—Parmelee, Miller, Welsh & Kratz

[57] ABSTRACT

The unplugging apparatus includes a conduit which extends through the wall of an annular member to a generally cylindrical lance housing disposed within the annular member. The upper end of the lance housing is disposed above and proximate the elevation of the conduit. A bushing is disposed within the housing at its upper end and guides upward movement of a tube which is partially disposed within the housing. The tube carries a charge of combustible material and has an upper end disposed outside the housing and a bottom flared portion disposed within the housing. The bushing defines a stop surface for the bottom flared portion of the tube. A combustible collar is mounted on the tube upper end and surrounds a portion of the charge of combustible material which extends past the tube upper end.

5 Claims, 2 Drawing Sheets

10
12
18
16
22
20
14
30
75
3
48
46
65
3
44
56
63
V
V
74
58
60
50
54
52
61
62
64
34
4
68
66
4
32'
78

75
5
5
68
77
70
72
64

64
62
66
67
78

APPARATUS FOR UNPLUGGING A VESSEL DISCHARGE PORT

BACKGROUND OF THE INVENTION

In vessels for molten metal having a discharge port which is controlled by a gate valve or the like, the port is frequently plugged. An unplugging apparatus is disclosed in U.S. Pat. No. 4,450,986 to Harasym et al. The unplugging apparatus disclosed in that patent provides a simple, reliable and inexpensive device which facilitates unplugging the discharge port while being safe and inhibiting contamination of the molten metal. The unplugging apparatus includes a conduit which extends through the wall of an annular member to a lance housing disposed within the annular member. The conduit introduces pressurized gas into the housing. The upper end portion of the lance housing includes a frustrum shaped portion and a reduced diameter cylindrical portion which guides upward movement of a tube. The tube carries a charge of combustible material. The upper end portion of the lance housing must be fabricated to strict tolerances to ensure that the tube longitudinal axis does not become skewed with respect to the longitudinal axis of the housing during travel of the tube. A skewed condition could result in binding contact between the bottom portion of the tube and the interior surface of the housing.

The tube has a nozzle tip provided with an opening for discharging pressurized gas and a cylindrical bottom portion provided with an opening for admitting the pressurized gas. The reduced diameter portion of the lance housing is elongated so that the relative lengths of the tube and housing are such that the tube does not leave the housing as it travels upwardly to contact plugged material in the vessel discharge port. A pressurized combustible gas such as oxygen is introduced through the conduit into the lance housing to propel the tube upwardly into contact with the material plugging the discharge port. Heat from the material plugging the discharge port ignites the gas discharging at the tip of the tube. If the pressure of the gas at the tip of the tube is too great, e.g. 250 psi, the discharging gas produces a chilling effect tending to inhibit ignition of the charge of combustible material.

The problems solved by the present invention are those of simplifying the fabrication of the lance housing while ensuring that the tube is retained in the housing during upward travel without contacting the interior surface of the housing, and eliminating the chilling effect of pressurized gas at the upper end of the tube so as to ensure ignition of the charge of combustible material.

BRIEF SUMMARY OF THE INVENTION

Improved apparatus for unplugging a vessel discharge port comprising an annular member having a refractory inner surface. A housing is supported within the annular member and is disposed substantially coaxial with the annular member. A conduit extends from the exterior of the annular member radially inwardly to the interior of the housing for introducing pressurized gas into the housing. The housing has an upper end disposed above and proximate the elevation of the conduit. A tube is at least partially disposed within the housing, substantially coaxial with the housing. The tube has an upper end disposed outside the housing and a bottom outwardly flared portion disposed within the housing. A bushing is disposed within and secured to the housing. The bushing defines a stop surface for the bottom flared portion of the tube. The tube is guided for upward movement by the bushing along the central longitudinal axis of the housing. Openings are provided at the tube upper end and bottom flared portion so that pressurized gas in the housing may enter the tube at the bottom end thereof and discharge through the tube upper end.

The tube may also be provided with a gas discharge opening along a wall portion thereof below the tube upper end so as to reduce gas pressure at the tube upper end. The housing bottom end may be provided with an opening for receiving the tube, and a plug may be secured to the housing bottom end to seal the housing.

A combustible charge of material is disposed within the tube. A portion of the charge of material extends above the elevation of the tube upper end. A combustible collar may be mounted on the upper end of the tube so as to surround the portion of the charge which extends above the elevation of the tube upper end.

DETAILED DESCRIPTION OF THE INVENTION

Figure 1:
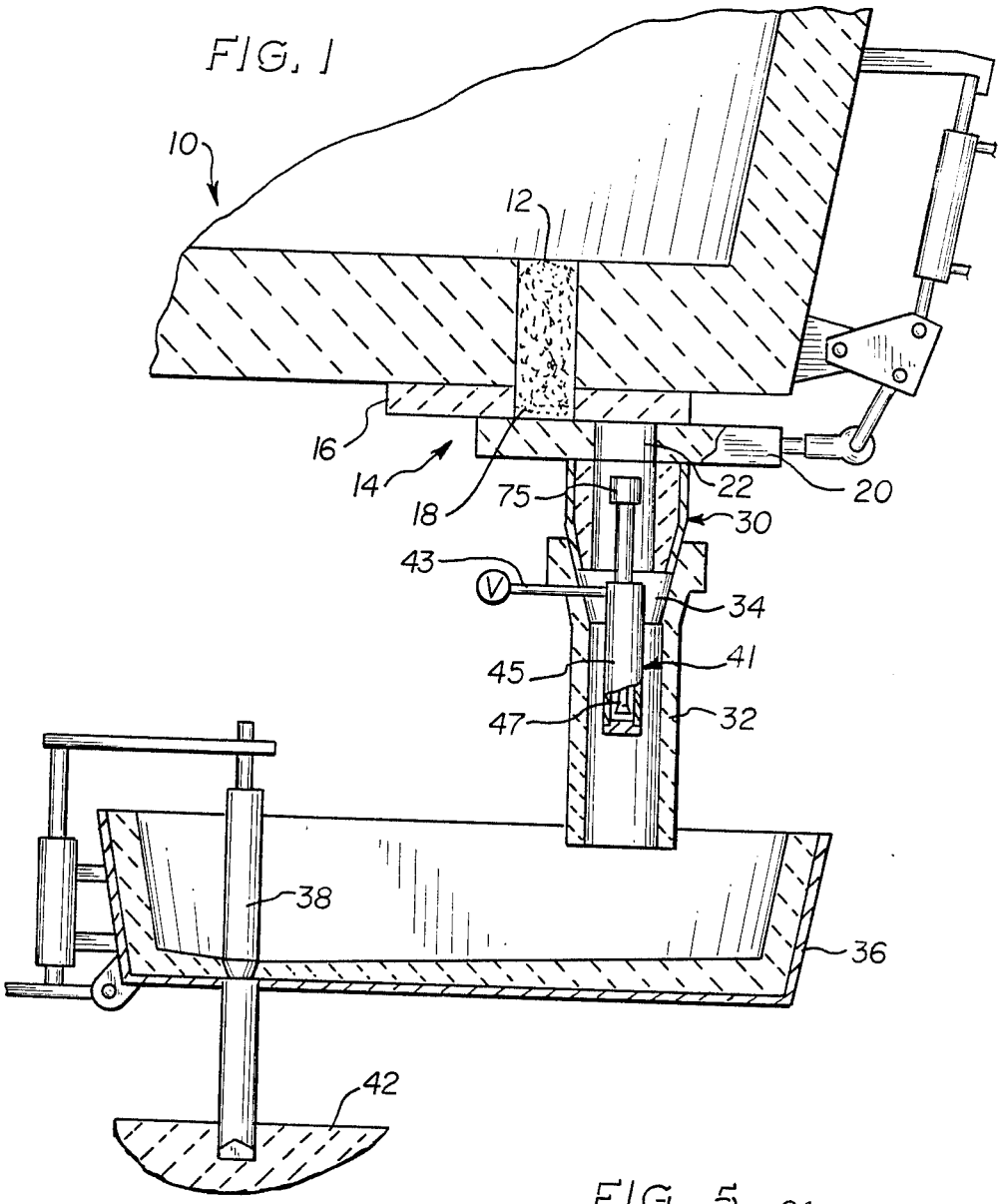
FIG. 1 is a vertical sectional view of the improved unplugging apparatus of the present invention with a ladle, shroud and tundish.

Referring to the drawings in detail, wherein like numerals indicate like elements, there is shown in FIG. 1 a vessel 10 having a discharge port 12 in a bottom wall thereof. For purposes of illustration, the vessel 10 will be a ladle. Flow of discharge of molten metal through port 12 is controlled by a gate valve 14.

The gate valve 14 includes a stationary plate 16 attached to the bottom wall of the ladle 10. Plate 16 has a flow passage 18 aligned with the port 12. A movable plate 20 is juxtaposed to plate 16 and has a flow passage 22 offset from flow passage 18 in a closed position of valve 14 as shown in FIG. 1. Plate 20 is provided with an actuator which may assume a variety of configurations such as that described in U.S. Pat. No. 4,450,986.

The movable plate 20 has a nozzle 30 fixedly secured thereto. The nozzle has a flow passage which is coaxial with the flow passage 22. Nozzle 30 is preferably a refractory ring having a metal liner on its outer face. The discharge end of nozzle 30 is tapered on its outer periphery and mates with tapered surface 34 on an annular member such as a shroud 32. Shroud 32 is a conventional structure made from a refractory material. The flow passage through the shroud 32 is coaxial with flow passage 22 and the flow passage through the nozzle 30 in the open position of plate 20.

The shroud 32 is supported for vertical movement toward and away from the nozzle 30. Such support is not illustrated and is conventional in the art. The lower end of the shroud 32 communicates with the upper end of a tundish 36. The discharge from the tundish 36 includes a port offset from the shroud 32 and controlled by a vertical stopper rod 38 as disclosed in U.S. Pat. No. 4,450,986. The flow port from the tundish 36 communicates by way of a shroud with a cavity in a mold 42.

When the valve 14 is open, the flow port is frequently plugged by sand or a solidified skin of molten metal. A telescoping lance 41 is supported within shroud 32 by a conduit 43. The lance 41 includes an outer housing 45 and an inner tube 47. A gas such as oxygen may be introduced under pressure into housing 45 by way of conduit 43 to cause tube 47 to move upwardly so as to physically contact the sand or skin plugging ports 12 and 18. Heat from the molten metal will ignite the oxygen discharging from the upper end of tube 47 to melt the skin of molten material. The lance 41 is consumed by the molten metal.

Figures 2, 3, 4:
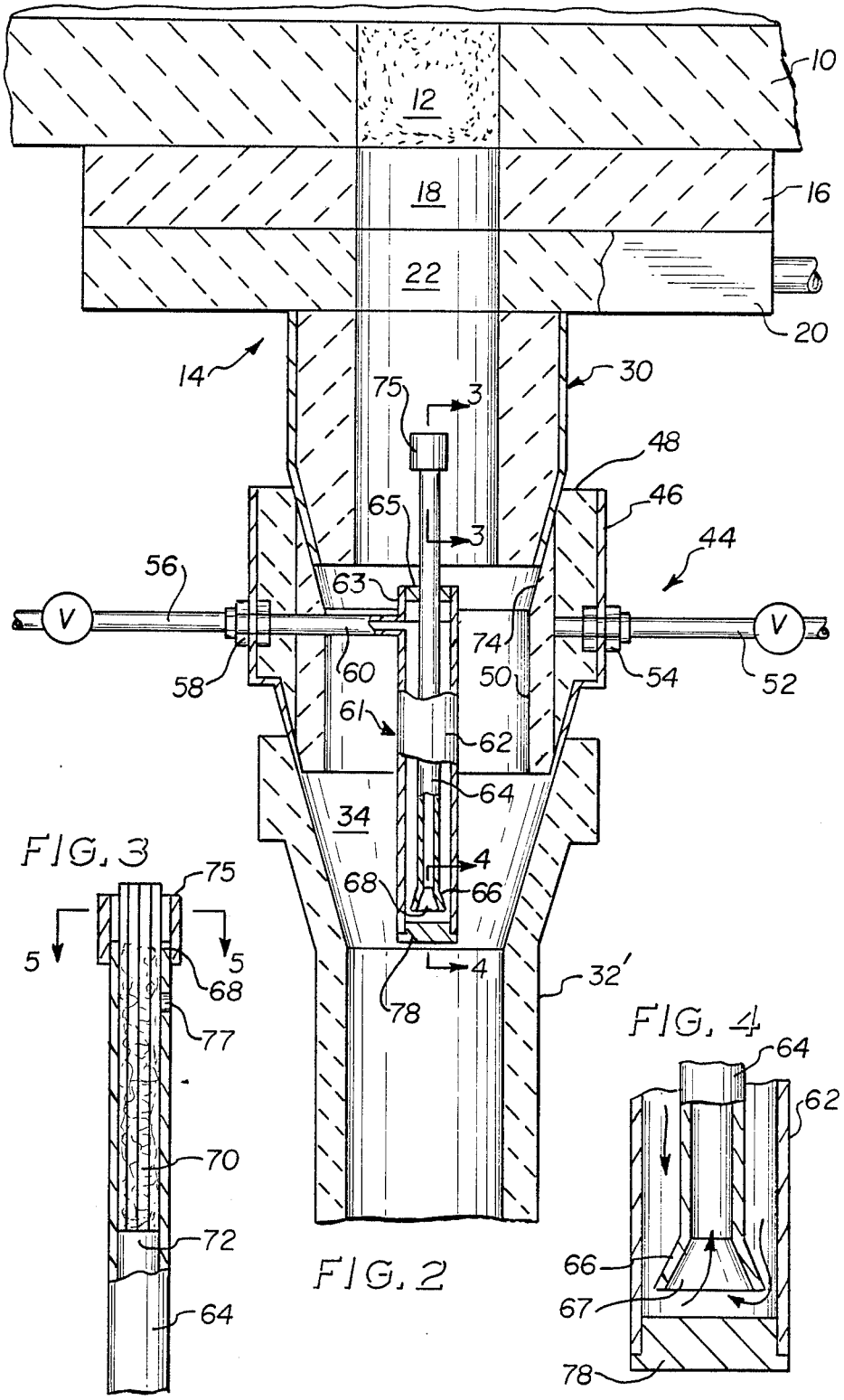
FIG. 2 is a vertical sectional view of another embodiment of the invention.
FIG. 3 is a sectional view taken along line 3—3 in FIG. 2 but on an enlarged scale.
FIG. 4 is a sectional view taken along the line 4—4 in FIG. 2 but on an enlarged scale.

In accordance with the preferred embodiment of the present invention shown in FIG. 2, the shroud 32' is conventional and is lowered so that an unplugging device 44 in accordance with the present invention is supported in the upper end thereof. Thereafter, the device and shroud are raised until the device is coupled to the nozzle 30.

As shown in FIG. 2, the unplugging device 44 is an annular member which includes a metal liner 46 surrounding an outer refractory liner 48 which in turn surrounds an inner refractory liner 50. Refractory liner 48 is preferably a porous refractory material while liner 50 is preferably impervious refractory material. A valved conduit 52 is connected to a a quick connect fitting 54 on the device 44. Fitting 54 communicates with the interface between the liners 48, 50. An inert gas such as argon may be introduced into such interface by way of conduit 52. If liners 48 and 50 are made in one piece, conduit 52 may be eliminated.

A valved conduit 56 is coupled to a quick disconnect fitting 58 on device 44. Fitting 58 communicates with conduit 60 which extends radially inwardly and supports a telescoping lance 61 including a generally cylindrical housing 62. Lances 41 and 61 are identical. Housing 62 is generally coaxial with the refractory liners 48, 50 and has an upper cylindrical end 63 disposed above but proximate the elevation of conduit 60. Thus, the housing upper end is not tapered.

Within the housing 62 and spaced from the inner surface thereof, there is provided a tube 64. The tube 64 is guided for upward movement within the housing 62 by a disc shaped bushing 65 fixedly secured to the housing upper end 63. As shown in FIGS. 3 and 4, tube 64 is generally cylindrical throughout but has an outwardly flared bottom portion 66 provided with an opening or passage 67 for admitting pressurized gas which has been introduced in the housing through conduits 56, 60. The bushing 65 defines a stop surface for the flared bottom portion 66 of tube 64.

Figure 5:
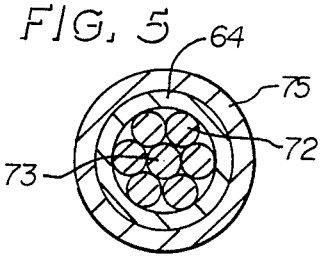
FIG. 5 is a sectional view taken along the line 5—5 in FIG. 3 but on an enlarged scale.

Within the tube 64, there is provided a charge of combustible material such as magnesium, low carbon steel, etc. Thus, combustible magnesium wires 72 are packed in the tube 64 and preferably extend past the tube upper end 68. Preferably, the magnesium wires 72 are intertwined with a combustible steel wool 70. A low temperature blasting fuse 73 ignitible for example at 450° F. may be inserted within the magnesium wires 72 and steel wool as shown in FIG. 5. A combustible collar 75 may be telescoped over the upper end 68 of the tube 64 so as to surround the portion of the magnesium wires which extends past the tube upper end. The collar may be made of a combustible cardboard material and may be secured to the upper end of the tube by a friction fit. The collar 75 may also be secured to the upper end of the tube 64 by means of tape.

I have found that the wires 72 ignite most reliably when the gas pressure at the upper end of the tube is relatively low such as 100 psi although combustion of the magnesium wires is most efficient at relatively higher gas pressures such as 250 psi. This is because gas discharging from the tube upper end at higher pressure such as 250 psi produces a chilling effect which tends to inhibit ignition. To ensure ignition of the portion of the wires at the upper end of tube 64, upon contact with the material plugging the vessel discharging port, a gas discharge or pressure relief port 77 is formed in a wall portion of the tube 64 below the upper end of the tube. The port 77 is sized so that pressurized gas introduced into the tube 64 will bleed through the port and thereby maintain the gas at the upper end of the tube above the elevation of port 77 at relatively low pressure such as 100 psi. Accordingly, upon contact with the material plugging port 18, the portion of the magnesium wires 72 extending above the elevation of the upper end of tube 64 will ignite without any chilling effect from the discharging pressurized gas at the tube upper end.

To further simplify fabrication, the tube 64 may be formed so as to be substantially cylindrical throughout. The bottom end of the housing 62 is open. In assembling the unplugging device 44 according to the present invention, the tube 64 is inserted in the housing bottom end and through the bushing 65. A tool is inserted through the bottom end of the housing and is forced in the bottom end of the tube 64 so as to flare the tube wall outwardly. A plug 78 is then secured to the bottom end of the housing 62 to seal the housing. The charge of combustible material is inserted in the tube 64, and combustible collar 75 is then telescoped over the upper end of the tube.

Operation of the preferred embodiment shown in FIG. 2 is as follows. When the slide valve 14 is open, and molten metal does not discharge through the nozzle 30, the slide valve is immediately closed. The shroud 32' is lowered. The device 44 is positioned on top of the shroud. Thereafter, the device 44 and shroud 32' are elevated until the tapered surface 74 on the upper end of the liner 50 mates with the taper on the outer surface on the lower end of the nozzle 30. Thereafter, inert gas is introduced to the interface between liners 58 and 50 by way of conduit 52.

The slide 14 is opened again, and thereafter, a gas capable of being ignited such as oxygen is introduced from conduit 56 through conduit 60 into the housing 62. The pressurized oxygen propels the tube 64 upwardly to position it into the aligned passages 18, 22 of the gate valve 14. The oxygen enters the tube through the flared bottom end 66, bleeds through the wall discharge port 77, and discharges through the upper end of the tube above port 77 at relatively low pressure. The heat of the adjacent molten metal ignites the oxygen and the charge of combustible material to thereby provide a device similar to a blow torch for unplugging the sand or skin of molten metal blocking flow of molten metal from the discharge port 12.

When the port 12 is unplugged, the molten metal flows through passages 18 and 22, through the nozzle 30, through the device 44 and through shroud 32' to the tundish 36. Conduit 60 as well as housing 62 and tube 64 are consumed by the molten metal and therefore are preferably made from a material such as thin walled low carbon steel which does not chill the molten metal and does not introduce any impurities. The inert gas continues to be introduced into the interface between liners 48 and 50 so long as molten metal is flowing from the ladle 10. As soon as molten metal commences flowing from the ladle 10, an inert gas such as argon is substituted for the gas flowing through conduit 60. After all the molten metal has been transferred from the ladle 10 to the tundish 36, the device 44 is removed. The device 44 may be considered expendible and discarded or in the alternative a new housing 62, tube 64 and conduit 60 may be attached for re-use of the device 44.

The improved construction of the lance housing 62 simplifies fabrication of the housing and makes possible a significant reduction in the amount of material required to fabricate the housing. These advantages are realized by eliminating the frustrum shaped portion and the elongated reduced diameter cylindrical portion of the lance housing disclosed in U.S. Pat. No. 4,450,986. Formation of these portions of the housing can be somewhat problematic as the portions must be formed to tight tolerances to ensure guidance of the tube 64 during upward movement of the tube while preventing the lower portion of the tube from contacting the interior surface of the housing 62. The disc shaped bushing 65 utilized in the present invention is relatively simple to fabricate by comparison. The central passage of the bushing, through which the tube 64 extends, is sized to ensure that the tube 64 remains aligned with the central longitudinal axis of the housing 62 as the tube moves upwardly thereby preventing contact between the lower portion of tube 64 and the interior surface of housing 62.

The improved construction of the tube 64 including relief port 77 ensures ignition of the portion of the charge of combustible material at the upper end of the tube without any chilling effect from the discharging gas. The flared bottom of tube 64 co-acts with bushing 65 to prevent ejection of the tube from housing 62.

The present invention may be embodied in other specific forms without departing from the spirit or essential attributes thereof and, accordingly, reference should be made to the appended claims, rather than to the foregoing specification, as indicating the scope of the invention.

I claim:

1. Improved apparatus for unplugging a vessel discharge port, comprising:

an annular member having a refractory inner surface, a housing supported within said member and substantially coaxial therewith, a conduit extending from the exterior of the annular member radially inwardly to the interior of the housing for introducing pressurized gas into said housing, said housing having an upper end disposed above and proximate the elevation of said conduit, a tube at least partially disposed within said housing and substantially coaxial therewith, said tube having an upper end disposed outside the housing and provided with an opening and a bottom outwardly flared portion disposed within the housing, a bushing disposed within and secured to said housing, said bushing defining a stop surface for said bottom flared portion of said tube, said tube being guided for upward movement by said bushing along the central longitudinal axis of said housing, said tube being open at said bottom flared portion so that pressurized gas in said housing may enter the tube and discharge through said opening at said tube upper end, and said apparatus further including a combustible charge or material disposed within said tube and having a portion which extends above the elevation of said tube upper end.

2. Improved apparatus according to claim 1 wherein said tube is provided with an opening along a wall portion thereof below said opening at said tube upper end so as to reduce gas pressure at said tube upper end.

3. Improved apparatus according to claim 1 wherein said housing has a bottom end provided with an opening for receiving said tube, and a plug for sealing said housing bottom end opening.

4. Improved apparatus according to claim 1 including a combustible collar mounted on the upper end of said tube and surrounding the portion of said charge of material which extends above the elevation of said tube upper end.

5. Improved apparatus for unplugging a vessel discharge port, said vessel having refractory pouring means associated therewith adapted to be positioned directly beneath said discharge port, said pouring means having an axial bore formed therein aligned with said discharge port, said improved unplugging apparatus comprising:

a housing having a hollow interior adapted to be supported within the bore of said refractory pouring means and positioned substantially coaxial therewith;

a conduit extending from a location exterior of the refractory pouring means and communicating with the interior of the housing for introducing pressurized gas into said housing;

a tube at least partially disposed within said housing and substantially coaxial therewith, said tube having an upper end disposed outside the housing and provided with an opening and a bottom outwardly flared portion disposed within the housing;

a bushing disposed within and secured to said housing, said bushing defining a stop surface for said bottom flared portion of said tube;

said tube being guided for upward movement by said bushing along the central longitudinal axis of said housing, said tube being open at said bottom flared portion so that pressurized gas in said housing may enter the tube and discharge through said opening at said tube upper end, and said apparatus further including a combustible charge of material disposed within said tube and having a portion which extends above the elevation of said tube upper end.

* * * * *